US007764018B2

(12) United States Patent
Ito et al.

(10) Patent No.: US 7,764,018 B2
(45) Date of Patent: Jul. 27, 2010

(54) GAS DISCHARGE TUBE

(75) Inventors: Yoshinobu Ito, Hamamatsu (JP); Tsuyoshi Minamizawa, Hamamatsu (JP); Koji Matsushita, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 237 days.

(21) Appl. No.: 11/658,320

(22) PCT Filed: Aug. 4, 2005

(86) PCT No.: PCT/JP2005/014331

§ 371 (c)(1),
(2), (4) Date: Jan. 24, 2007

(87) PCT Pub. No.: WO2006/016521

PCT Pub. Date: Feb. 16, 2006

(65) Prior Publication Data

US 2007/0296338 A1 Dec. 27, 2007

(30) Foreign Application Priority Data

Aug. 10, 2004 (JP) ..... 2004-233725

(51) Int. Cl.
*H01J 17/02* (2006.01)

(52) U.S. Cl. ..... 313/611; 313/609; 313/631; 313/567

(58) Field of Classification Search ..... 313/623, 313/627–643, 567, 111–117, 25–27, 318.01–318.09; 439/615, 739; 445/24, 26, 29, 22
See application file for complete search history.

(56) References Cited

U.S. PATENT DOCUMENTS 5,191,260 A 3/1993 Kawai et al.
5,698,945 A * 12/1997 Ikedo et al. ..... 313/613

(Continued)

FOREIGN PATENT DOCUMENTS

JP 4-341749 11/1992

(Continued)

*Primary Examiner*—Peter J Macchiarolo
*Assistant Examiner*—Donald L Raleigh
(74) *Attorney, Agent, or Firm*—Drinker Biddle & Reath LLP

(57) ABSTRACT

A gas discharge tube which generates discharge between an anode 24 and a cathode 56 disposed within a sealed container 12 in which a gas is sealed, includes a cylindrical part 28 restricting the discharge path, the cylindrical part being disposed between the anode and the cathode and having a through hole 42 for narrowing the discharge path between the anode and the cathode, and a discharge shielding part 50 which is disposed so as to cover a surrounding of the part restricting the discharge path and is electrically insulated from the part restricting the discharge path, wherein the part restricting the discharge path has a cathode side end projecting by a predetermined projecting amount more than a surface on the cathode side of the discharge shielding part and an anode side end projecting into a space 62 on the side where the anode is positioned so that a high-density electron region is formed only in a part on the cathode side of the through hole of the part restricting the discharge path to reliably generate starting discharge, preferably perform heat radiation of the anode, and reduce evaporated products from the anode.

14 Claims, 10 Drawing Sheets

U.S. PATENT DOCUMENTS

| | | | | |
|---|---|---|---|---|
| 2002/0054493 | A1 | 5/2002 | Sei et al. | |
| 2005/0231119 | A1* | 10/2005 | Ito et al. | 313/634 |

FOREIGN PATENT DOCUMENTS

| | | |
|---|---|---|
| JP | 7-288106 | 10/1995 |
| JP | 7-326324 | 12/1995 |
| JP | 10-64479 | 3/1998 |
| JP | 2000-173547 | 6/2000 |
| JP | 2002-151008 | 5/2002 |
| JP | 2002-151009 | 5/2002 |
| JP | 2003-68247 | 3/2003 |
| JP | 2003-68250 | 3/2003 |
| WO | 03/094199 | 11/2003 |
| WO | 2004/075243 | 9/2004 |

* cited by examiner

GAS DISCHARGE TUBE

TECHNICAL FIELD

The present invention relates to a gas discharge tube, more specifically, to a gas discharge tube of a deuterium lamp to be used as a light source of a spectroscope or chromatography.

BACKGROUND ART

As a conventional technique in the above-described field, there are techniques described in Patent document 1 and 2 listed below. Gas (deuterium) discharge tubes described in these patent documents both have a metal-made barrier on a discharge path between an anode and a cathode, and in this barrier, a small hole is formed so as to narrow the discharge path. In this construction, light with high luminance can be obtained by the small opening on the discharge path. Particularly, in the gas discharge tube described in Patent document 1, the small hole, that is, the portion to narrow the discharge path is lengthened to further increase the luminance. On the other hand, in the gas discharge tube described in Patent document 2, the length of the small hole is increased and a plurality of barriers are provided to make the luminance higher.

Patent document 1: Japanese Published Unexamined Patent Application No. H07-288106

Patent document 2: Japanese Published Unexamined Patent Application No. H10-64479

DISCLOSURE OF THE INVENTION

Problem to be Solved by the Invention

The demand for higher luminance of the gas discharge tube is comparatively satisfied by these techniques. However, when the portion to narrow the discharge path is increased in length, discharge becomes difficult to be generated. This problem is avoided in the gas discharge tube described in Patent document 2 by providing a plurality of metal-made barriers so as to generate discharge stepwise, however, as a result, the power supply circuit becomes complicated.

Therefore, an object of the invention is to provide a gas discharge tube which can reliably generate discharge while realizing higher luminance.

Means for Solving the Problem

To solve the above-described problem, the present invention provides a gas discharge tube which emits light to the outside from a light exit window of a sealed container in which a gas is sealed by generating discharge between an anode and a cathode which are disposed in the sealed container, including (i) a cylindrical part restricting a discharge path, the cylindrical part being disposed between the anode and the cathode and having a through hole for narrowing the discharge path between the anode and the cathode, the cylindrical part being conductive and being electrically connected to an external power source; (ii) a discharge shielding part which is disposed so as to cover a surrounding of the part restricting the discharge path and is electrically insulated from the part restricting the discharge path, wherein the part restricting the discharge path has an end on the cathode side projecting by a predetermined projecting amount more than a surface on the cathode side of the discharge shielding part and an end on the anode side projecting into a space where the anode is positioned. The projecting amount on the cathode side of the part restricting the discharge path is preferably not more than 0.5 mm.

In this construction, most of the discharge path from the outer peripheral surface of the part restricting the discharge path to the cathode is shielded by the discharge shielding part, and only a part of the end on the cathode side of the part restricting the discharge path, that is, only a projecting portion of 0.5 mm at maximum forms a discharge path for starting discharge between the projecting portion and the cathode, so that when a starting power is applied, a high-density electron region is formed only near the projecting tip end of the part restricting the discharge path and at a part on the cathode side of the through hole. As a result, starting discharge is reliably generated. In addition, the part restricting the discharge path projects by a predetermined amount into a space on the side where the anode is positioned, so that the space on the side where the anode is positioned is expanded and heat radiation of the anode is preferably performed in this space and a temperature rise of the anode is prevented. As a result, evaporated products from the anode are reduced.

As a construction which effectively brings about the above-described action, in detail, a part restricting the discharge path support for supporting the part restricting the discharge path is provided, and the part restricting the discharge path has, on its outer peripheral surface a flange portion to be supported by the support for the part restricting the discharge path, and the end faces on the cathode side and the anode side of the part restricting the discharge path project toward the cathode side and the anode side, respectively, from this flange portion, and this construction makes easy the positioning and attaching of the part restricting the discharge path. The support for the part restricting the discharge path supports the flange portion provided in the middle of the longitudinal direction of the part restricting the discharge path, so that in comparison with the case where the support supports the end portion on the anode side of the part restricting the discharge path having the same length, the thickness of the support for the part restricting the discharge path in this longitudinal direction can be reduced, and the gas discharge tube can be made compact.

It is preferable that the through hole in the part restricting the discharge path includes a small hole with a constant inner diameter provided on the anode side and an expanded diameter hole in a funnel shape which extends to the cathode side continuously from the small hole and whose inner diameter is expanded toward the cathode side. This is because the small hole functions as a portion to narrow discharge, the expanded diameter hole forms a satisfactory arc ball at the inside and these contribute to an increase in luminance.

Furthermore, the boundary between the small hole and the expanded diameter hole is set closer to the anode side than the surface on the cathode side of the discharge shielding part, whereby the high-density electron region is formed so as to especially concentrate on the inside of the expanded diameter hole, and starting discharge is more reliably generated. When the inner diameter of the small hole of the part restricting the discharge path is defined as D1 and the maximum inner diameter of the expanded diameter hole is defined as D2, setting of D2 to be not less than 1 mm and not more than 3 mm and a ratio of D2/D1 to be not less than 4 and not more than 10 is effective for higher density of the electron region and satisfactory arc ball forming. It is preferable that the discharge shielding part is made of an electrical insulating material so as to easily realize electrical insulation from the part restricting the discharge path.

EFFECT OF THE INVENTION

As described above, the gas discharge tube of the invention has a part restricting the discharge path which sufficiently narrows discharge and brings about an effect of obtaining high luminance, and due to the positional relationship between the part restricting the discharge path and the discharge shielding part, starting discharge is reliably generated at the tip end of the part restricting the discharge path, so that an effect is brought about that starting discharge progresses stepwise and main discharge is also reliably generated. In addition, evaporated products from the anode are reduced, so that stable discharge can be maintained over a long period of time. Complicated power supply circuits are unnecessary, and this contributes to reduction in the total cost of an apparatus using the gas discharge tube of the invention.

DESCRIPTION OF THE REFERENCE NUMERALS

Figure 1:
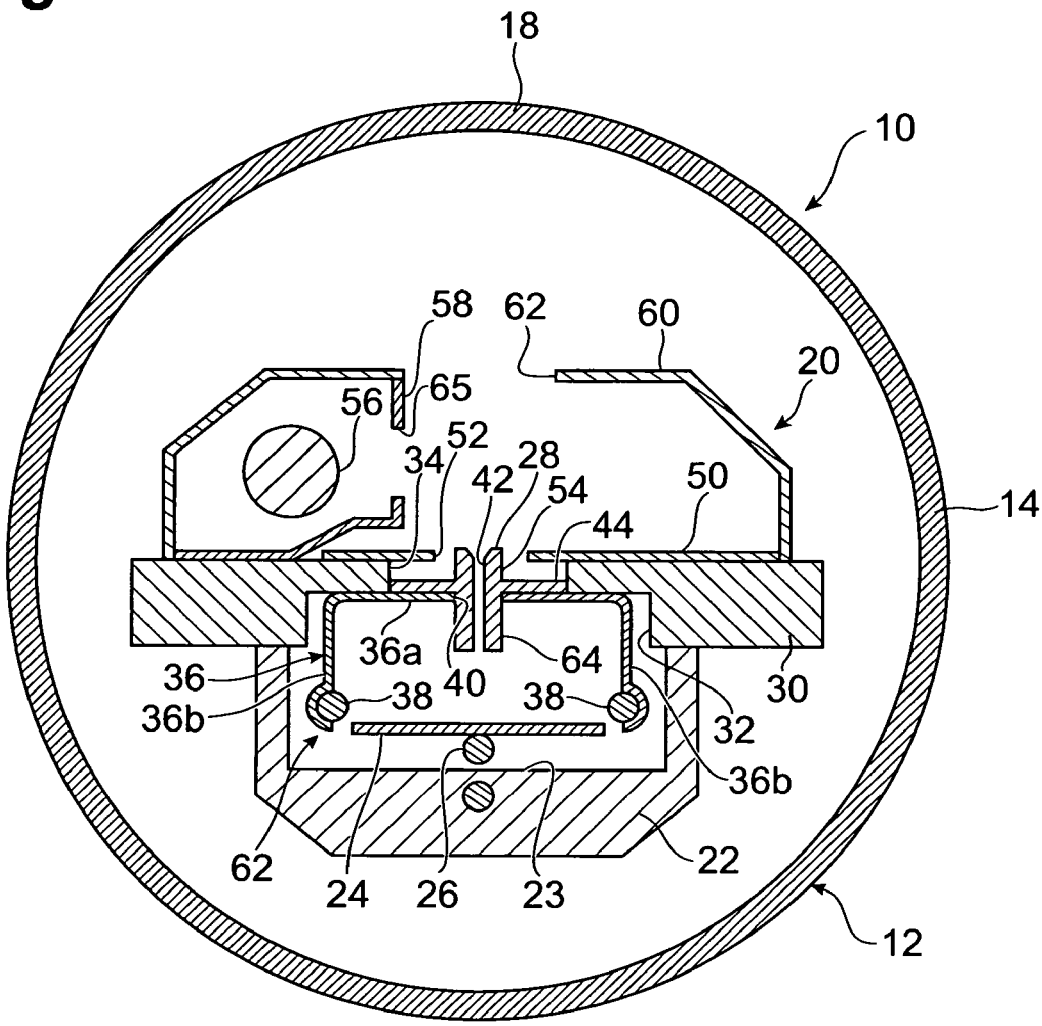
FIG. 1 is a sectional view showing a first embodiment of a gas discharge tube of the invention.

10, 110, 210, 310, 410: gas discharge tube
12, 212: sealed container
18, 218: light exit window
20, 220: light emitting part assembly
24, 224: anode
28, 128, 228: part restricting the discharge path
30, 130, 230, 300: support for the part restricting the discharge path
42, 242: through hole
44: flange (flange portion), 46, 246: small hole
48, 248: expanded diameter hole
50, 150, 250: discharge shielding part
52, 152, 252: opening
54: first projecting portion (part restricting the discharge path)
56, 256: cathode
62, 362, 462: space on the side where the anode is positioned
64: second projecting portion (part restricting the discharge path)
65, 265: opening
270: support for the discharge shielding part

BEST MODES FOR CARRYING OUT THE INVENTION

Figure 2:
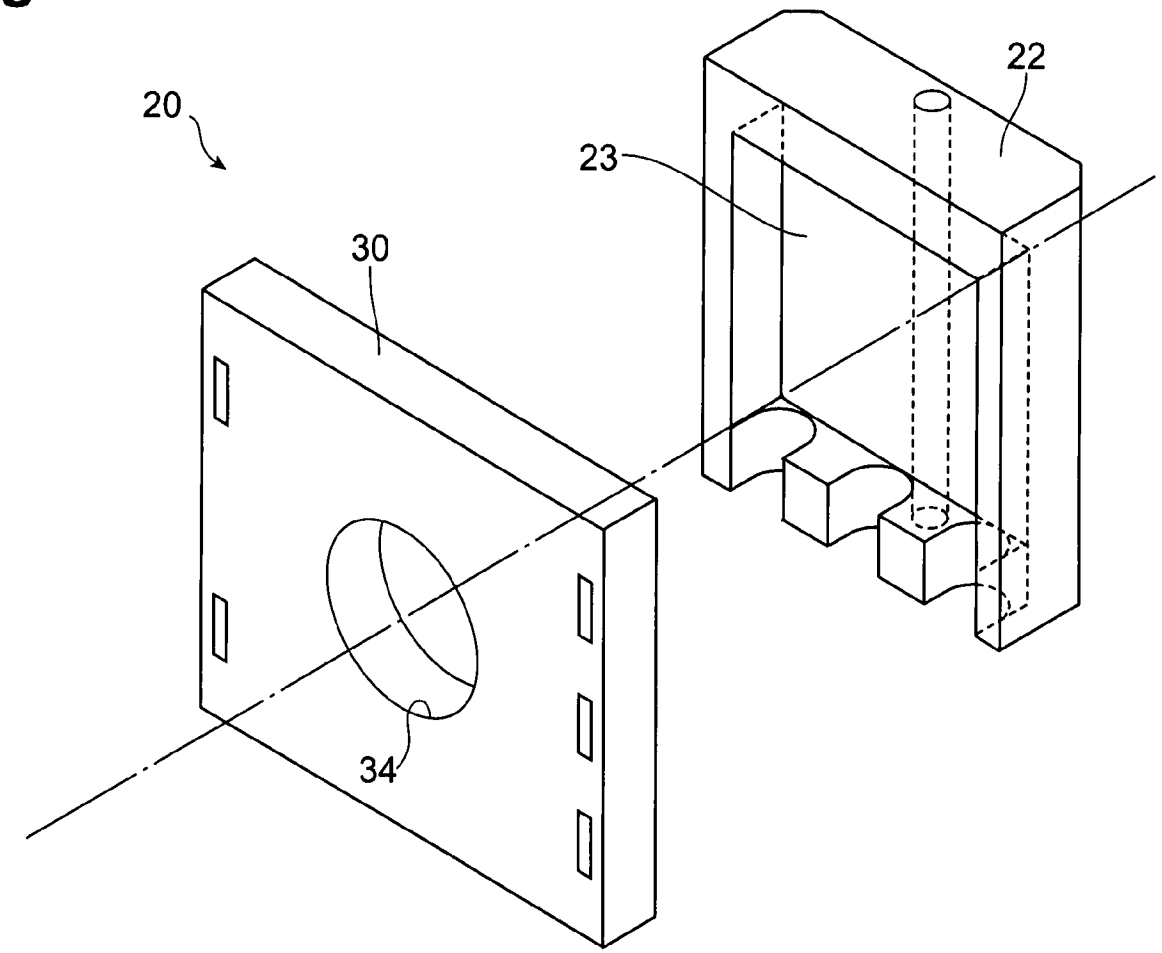
FIG. 2 is an exploded perspective view showing a support for the part restricting the discharge path and a base of a light emitting part assembly of FIG. 1.
Figure 3:
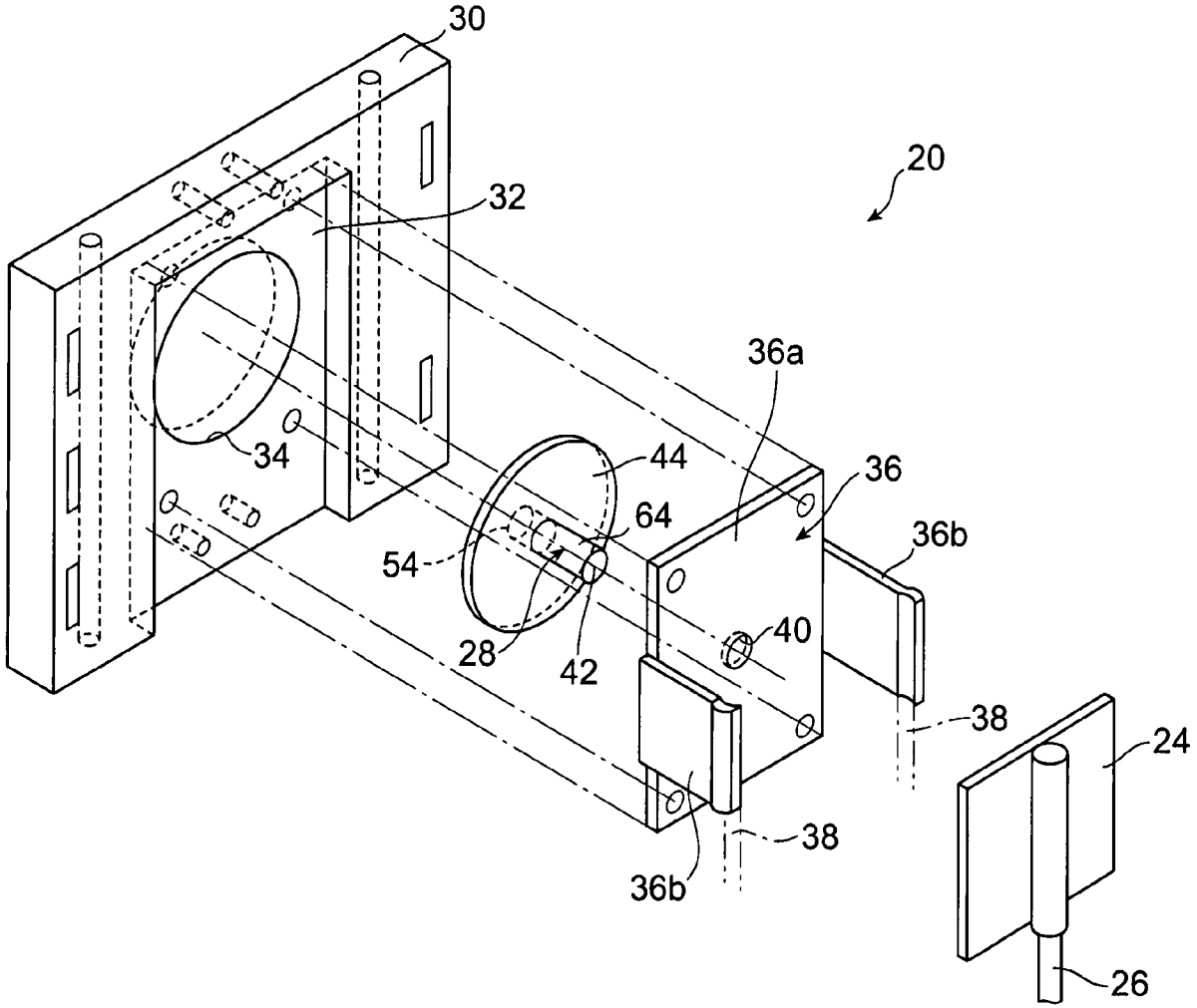
FIG. 3 is an exploded perspective view showing the support for a part restricting the discharge path, a part restricting the discharge path, and an anode of the light emitting part assembly of FIG. 1.
Figure 4:
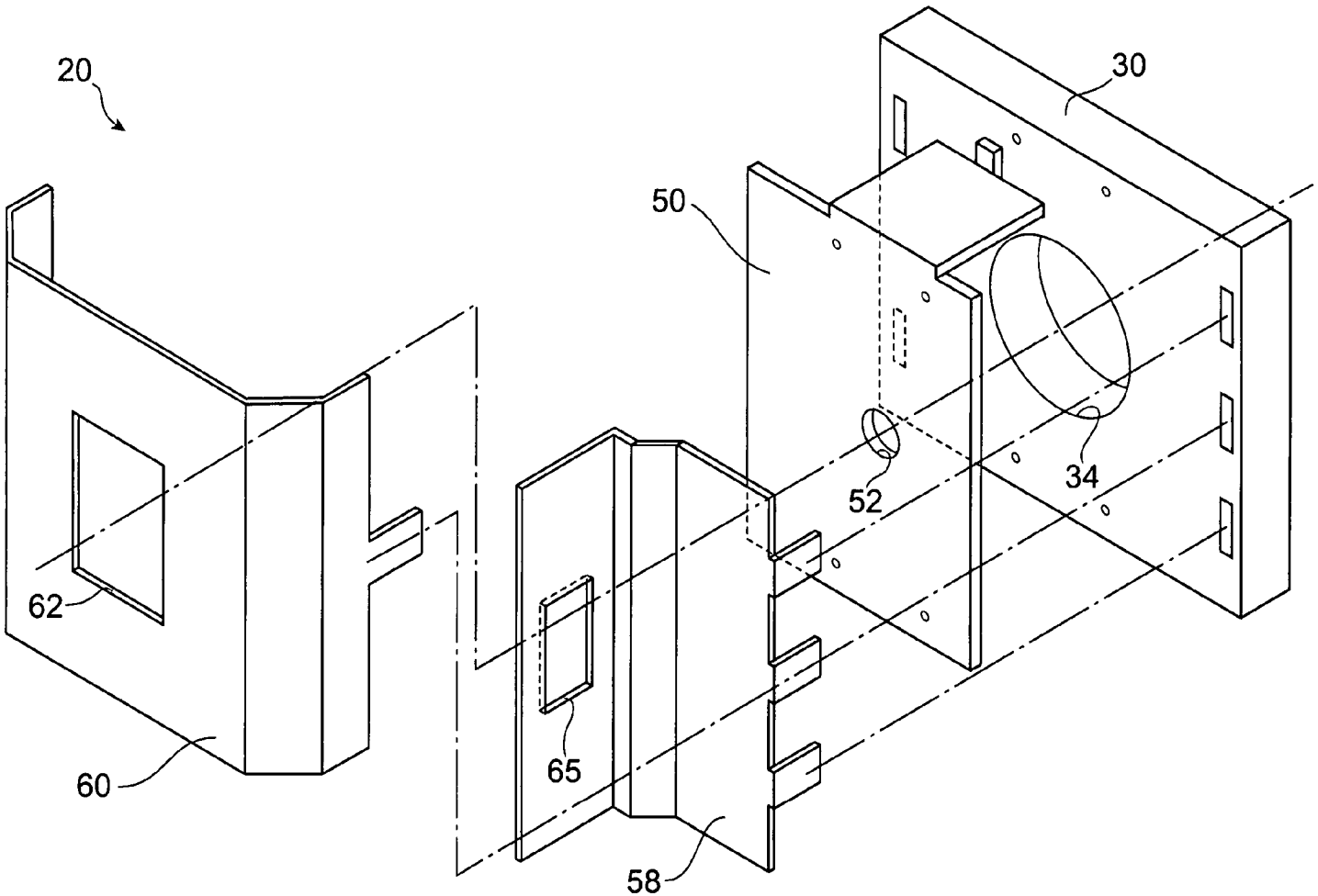
FIG. 4 is an exploded perspective view showing the support for the part restricting the discharge path, a discharge shielding part, a discharge rectifier plate, a cathode, and a front cover of the light emitting part assembly of FIG. 1.
Figure 5:
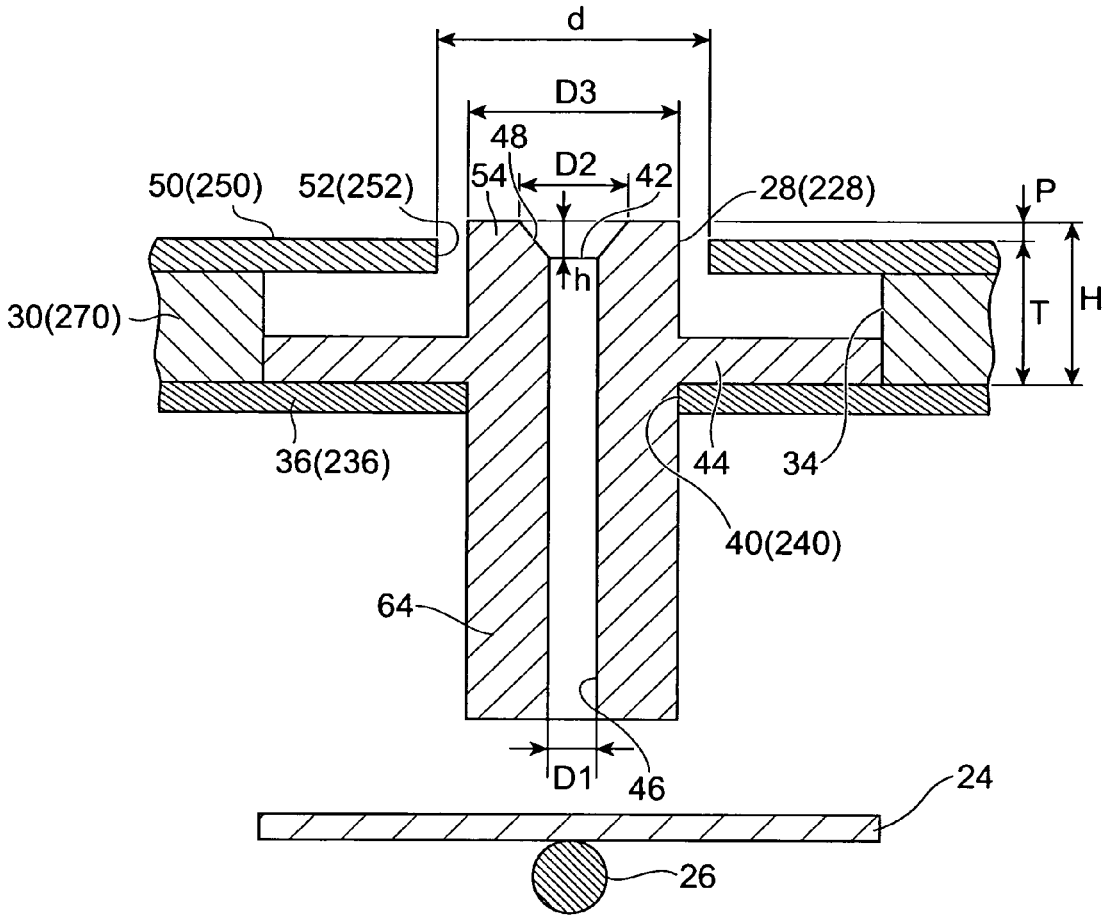
FIG. 5 is a sectional view showing the part restricting the discharge path and a periphery thereof in the gas discharge tube of FIG. 1 in an enlarged manner.

Hereinafter, preferred embodiments of the invention will be described with reference to the accompanying drawings. For easy understanding of the description, the same reference numbers are attached wherever possible to the same components in the respective drawings, and overlapping description is omitted. FIG. 1 is a sectional view of a first embodiment of a gas discharge tube of the invention, cut in a direction perpendicular to an axial (tube axis) direction, FIG. 2 through FIG. 4 are exploded perspective views of the light emitting part assembly of FIG. 1, and FIG. 5 is a sectional view of a part restricting the discharge path and a periphery thereof in the gas discharge tube of FIG. 1 in an enlarged manner. In the following description, the terms which indicate directions such as "upward" and "downward" directions are referred to according to the states of the drawings.

The gas discharge tube 10 shown in FIG. 1 is a so-called side-on type deuterium lamp, and is used as a light source of, for example, an analyzer or a semiconductor inspection apparatus. This gas discharge tube 10 includes a glass-made sealed container 12 in which a deuterium gas is sealed by a pressure of several hundreds Pa, and a light emitting part assembly 20 which includes an anode 24 and a cathode 56 and emits an ultraviolet ray.

The sealed container 12 includes a cylindrical side tube portion 14 one end side of which is sealed and a stem portion (not shown) which seals the other end side of this side tube portion 14, and a part of the side tube portion 14 is used as a light exit window 18. In this sealed container 12, the light emitting part assembly 20 is housed.

This light emitting part assembly 20 includes, as shown in FIG. 1 through FIG. 3, an electrical insulating base 22 in a substantially rectangular plate shape made of ceramics or the like, and a support for the part restricting the discharge path (hereinafter, referred to as "support") 30. The base 22 and the support 30 are disposed in contact with each other to face each other, and in the surfaces facing each other, concave portions 23 and 32 are formed, respectively. A space formed by these concave portions 22 and 23 becomes an anode housing space (space on the side where the anode is positioned) 62 for housing the anode 24. In this anode housing space 62, in addition to the anode 24, a part of the part 28 restricting the discharge path described later and a conductive plate 36 to be connected to this part 28 restricting the discharge path are housed.

At the substantially center of the concave portion 32 of the support 30, a circular opening 34 is formed. The support 30 is disposed so that this opening 34 faces the light exit window 18.

The anode 24 has a substantially rectangular planar shape, and is disposed on a side apart from the concave portion 32 of the anode housing space 62 so that its surface faces the light exit window 18. To the back side of the anode 24, a tip end of a stem pin 26 which is stood on the stem portion and extends in the tube axis (central axis of the side tube portion 14) direction is fixed and electrically connected.

The conductive plate 36 includes, as shown in FIG. 1 and FIG. 3, a conductive plate main body 36*a* in a rectangular planar shape, and at a center thereof, a circular opening 40 is formed. This conductive plate main body 36*a* is accommodated in the concave portion 32 of the support 30 and positioned so that the opening 34 of the support 30 and the opening 40 of the conductive plate 36 become coaxial with each other, and is fixed to the support 30 by, for example, pins or the like. On side edges of the conductive plate 36, a pair of arms 36*b* extending toward the anode 24 are provided. To the arms 36*b*, tip ends of stem pins 38 which are stood on the stem portion and extend in the tube axis (central axis of the side tube portion 14) direction are fixed and electrically connected. The inner diameter of the opening 40 of the conductive plate 36 is made substantially the same as the outer diameter of the part 28 restricting the discharge path which will be described in detail below.

As shown in FIG. 5, the part 28 restricting the discharge path has a cylindrical shape and is inserted into the opening 40 of the conductive plate 36, and is made of metal such as molybdenum, tungsten, or an alloy of these and has conductivity. In the middle in the axial direction of the part 28 restricting the discharge path, a flange (flange portion) 44 to be supported by the support 30 via the conductive plate 36 is formed, and the outer diameter of this flange 44 is made substantially the same as the inner diameter of the opening 34 of the support 30. The surface on the anode 24 side of this flange 44 is fixed and electrically connected to the conductive plate main body 36*a*, and is inserted into the opening 34 of the support 30 by attaching the conductive plate main body 36*a* to the support 30.

The portion from the end portion on the cathode 56 side opposite the anode 24 side of the part 28 restricting the discharge path to the flange 44 is formed as a first projecting portion 54 projecting toward the cathode 56 side, and the portion from the flange 44 to the end portion on the anode 24 side is formed as a second projecting portion 64 projecting toward the anode 24 side. This second projecting portion 64 is disposed so as to project by a predetermined amount to the anode housing space 62. Therefore, the anode housing space 62 has a predetermined size so as to house the second projecting portion 64 and the anode 24.

Inside the part 28 restricting the discharge path, a through hole 42 for narrowing or restricting the discharge path from the anode 24 extends in the axial direction thereof. This through hole 42 of the part 28 restricting the discharge path includes a small hole 46 with a constant inner diameter provided on the anode 24 side, and an expanded diameter hole 48 in a funnel shape which extends upward (to the cathode 56 side) continuously from the small hole and whose inner diameter is expanded upward (to the end side). The small hole 46 is a portion for mainly narrowing the discharge path, and the expanded diameter hole 48 is mainly for arc ball forming, and in this embodiment, an inner peripheral surface of the expanded diameter hole is a conical surface. For narrowing the discharge, it is preferable that the inner diameter D1 of the small hole 46 is approximately 0.5 mm. Preferably, the maximum inner diameter D2 of the expanded diameter hole 48, that is, the inner diameter D2 of the through hole 42 on the end face on the cathode 56 side is set to be not less than 1 mm and not more than 3 mm and a ratio D2/D1 to the inner diameter D1 of the small hole 46 becomes not less than 4 and not more than 10.

On the surface on the light exit window 18 side of the support 30, as shown in FIG. 1 and FIG. 4, a planar discharge shielding part 50 is disposed in contact with it. In this first embodiment, the discharge shielding part 50 is made of a conductive material such as a metal. The discharge shielding part 50 has an opening 52 at a substantially center thereof, and the discharge shielding part 50 is positioned with respect to the support 30 so that the opening 52 and the opening 34 of the support 30 becomes coaxial with each other, and is fixed by pins or the like.

The opening 52 of the discharge shielding part 50 has an inner diameter d slightly larger than the outer diameter D3 of the first projecting portion 54 as shown in FIG. 5. In an assembled state, the first projecting portion 54 is inserted into the opening 52 of the discharge shielding part 50, and the discharge shielding part 50 surrounds the surrounding of the first projecting portion 54. A gap is formed between the inner peripheral surface of the opening 52 of the discharge shielding part 50 and the outer peripheral surface of the first projecting portion 54 of the part 28 restricting the discharge path, however, the size of the gap 5 is very small so that leak of discharge from this gap becomes very little or substantially zero. Due to the presence of this gap, the discharge shielding part 50 attached to the electrical insulating support 30 is electrically insulated from the part 28 restricting the discharge path, and is not in contact with other portions to which potentials are applied, so that the discharge shielding part is in a floating state in terms of potential.

A total H of the length of the first projecting portion 54 in the longitudinal direction of the part 28 restricting the discharge path and the thickness of the flange 44 is slightly larger than a total T of the thickness of the support 30 and the thickness of the discharge shielding part 50, and an upper end (cathode 56 side end) of the part 28 restricting the discharge path projects upward (to the cathode 56 side) from the upper surface (cathode 56 side surface) of the discharge shielding part 50. This projecting amount P is preferably not more than 0.5 mm, and more preferably, approximately 0.3 mm.

Furthermore, the length h in the axial direction of the expanded diameter hole 48 that is a cathode 56 side portion of the through hole 42 in the part 28 restricting the discharge path is larger than the projecting amount P. Namely, the lower end of the expanded diameter hole 48 (boundary between the expanded diameter hole 48 and the small hole 46) is closer to the anode 24 side than the upper surface (cathode 56 side surface) of the discharge shielding part 50.

The light emitting part assembly 20 including the part 28 restricting the discharge path, the base 22, and the support 30, etc., has a cathode 56 disposed at a position (left side) on the light exit window 18 side deviated from an optical path as shown in FIG. 1 and FIG. 4. This cathode 56 is for generating thermions, and in detail, the cathode is formed by applying electron radiating matter to the surface of a tungsten coil extended in the tube axis direction. Such a cathode 56 is electrically connected to an external power source via a connecting pin on the tip end of the stem pin stood on the stem portion and can be supplied with power from the outside although this is not shown.

Furthermore, the light emitting part assembly 20 has a metal-made front cover 60 and a discharge rectifier plate 58 so as to prevent spatter or evaporated products generated from the cathode 56 from adhering to the light exit window 18. The front cover 60 is disposed so as to cover the surface on the light exit window 18 side of the support 30 and the cathode 56 and is fixed to the support 30. In this front cover 60, at a position corresponding to the opening 52 of the discharge shielding part 50, a light pass-through opening 62 through which an ultraviolet ray passes is formed. The discharge rectifier plate 58 is disposed so as to surround the cathode 56 in conjunction with the cathode 56 side (left side of FIG. 1) portion of the front cover 60, and is fixed to the support 30. In a portion of the discharge rectifier plate 58 facing the cathode 56, an opening 65 is formed, and thermions generated in the cathode 56 pass through this opening 65.

Next, operations of the gas discharge tube 10 mentioned above will be described. First, before discharge, a power of approximately 10 W is supplied for approximately 20 seconds to the cathode 56 via a stem pin (not shown) from an external power source for cathode (not shown) to preheat the coil forming the cathode 56. Next, between the cathode 56 and the anode 24, a voltage of approximately 160V is applied via the stem pin 26 from an external power source for main discharge (not shown) to make preparations for arc discharge.

Thereafter, from an external power source for trigger (not shown), a predetermined voltage, for example, a voltage of approximately 350V is applied between the part 28 restricting the discharge path and the anode 24 via the stem pins 38 and 26. Then, between the cathode 56 and a projecting portion of the part 28 restricting the discharge path projecting to the side of the cathode 56 more than the upper surface of the discharge shielding part 50, starting discharge is generated.

Herein, in this embodiment, most of the discharge path from the outer peripheral surface of the part 28 restricting the discharge path toward the cathode 56 is shielded by the discharge shielding part 50, and only the end of the first projecting portion 54 of the part 28 restricting the discharge path, that is, only a portion of the projecting amount P of 0.5 mm at maximum, preferably 0.3 mm forms a discharge path for starting discharge between the portion and the cathode 56, so that a high-density electron region is formed only inside and near the expanded diameter hole 48 of the part 28 restricting the discharge path. Additionally, the conical inner peripheral surface of the expanded diameter hole 48 extends further downward than the upper surface of the discharge shielding part 50, so that the high-density electron region is formed especially inside the expanded diameter hole 48. As a result, the starting discharge is reliably generated.

When starting discharge is generated between the upper end of the part 28 restricting the discharge path and the cathode 56, subsequently, starting discharge is also generated between the cathode 56 and the anode 24, and thereafter, main discharge (arc discharge) is generated by the external power source for main discharge. Discharge can be thus generated stepwise, and therefore, even when the total length (H+the length of the second projecting portion 64) of the part 28 restricting the discharge path is set to be sufficient to narrow discharge (for example, not less than 2 mm), the main discharge can be reliably generated.

After the main discharge is generated, the power from the external power source for cathode is adjusted so as to optimize the temperature of the cathode 56. Thereby, between the cathode 56 and the anode 24, the main discharge is maintained, and an arc ball is formed in the expanded diameter hole 48 of the part 28 restricting the discharge path. Thus, in the part 28 restricting the discharge path, discharge is narrowed while maintaining a sufficient length, and the arc ball is formed, so that a generated ultraviolet ray is emitted as light with very high luminance through the light exit window 18 of the sealed container 12 from the light pass-through opening 62 between the discharge rectifier plate 58 and the front cover 60. Herein, the inner peripheral surface of the expanded diameter hole 48 is conical and the maximum inner diameter D2 of the expanded diameter hole 48 is not less than 1 mm and not more than 3 mm and the ratio D2/D1 to the inner diameter D1 of the small hole 46 is set to be not less than 4 and not more than 10, so that the arc ball formed is in a stable satisfactory shape. Therefore, the luminance and light amount of the light to exit also become stable. By setting D1 and D2 to the above-described dimensions, the increase in density of the electron region in the expanded diameter hole 48 is further promoted.

In this embodiment, the part 28 restricting the discharge path projects to the anode 24 side, and the anode housing space 62 for housing the second projecting portion 64 and the anode 24 is formed as a sufficient space, so that heat radiation of the anode 24 is preferably performed in this anode housing space 62, a temperature rise of the anode 24 is prevented, and evaporated products from the anode 24 are reduced. Therefore, stable discharge can be maintained over a long period of time. In addition, the complicated power supply circuit as in the case where a plurality of metal-made barriers are disposed becomes unnecessary, and this contributes to reduction in the total cost of an apparatus using the gas discharge tube of the present invention.

In the present invention, the part 28 restricting the discharge path has, on its outer peripheral surface, a flange 44 for supporting the part 28 restricting the discharge path, and the end on the anode 24 side of the part 28 restricting the discharge path projects more than the surface on the anode 24 side of the flange 44, so that the positioning and attaching of the part 28 restricting the discharge path become easy. Furthermore, the support 30 which supports the part 28 restricting the discharge path supports the flange 44 that is provided in the middle in the longitudinal direction of the part 28 restricting the discharge path, so that in comparison with the case where the support supports the anode 24 side end of the part 28 restricting the discharge path having the same length, the thickness of the support 30 in the same longitudinal direction of the support can be reduced, and the gas discharge tube 10 is downsized. Furthermore, the support 30 made of ceramic with high heat storage performance is made thin to increase the size of the anode housing space 62, so that heat radiation of the anode 24 is more effectively performed.

Figure 6:
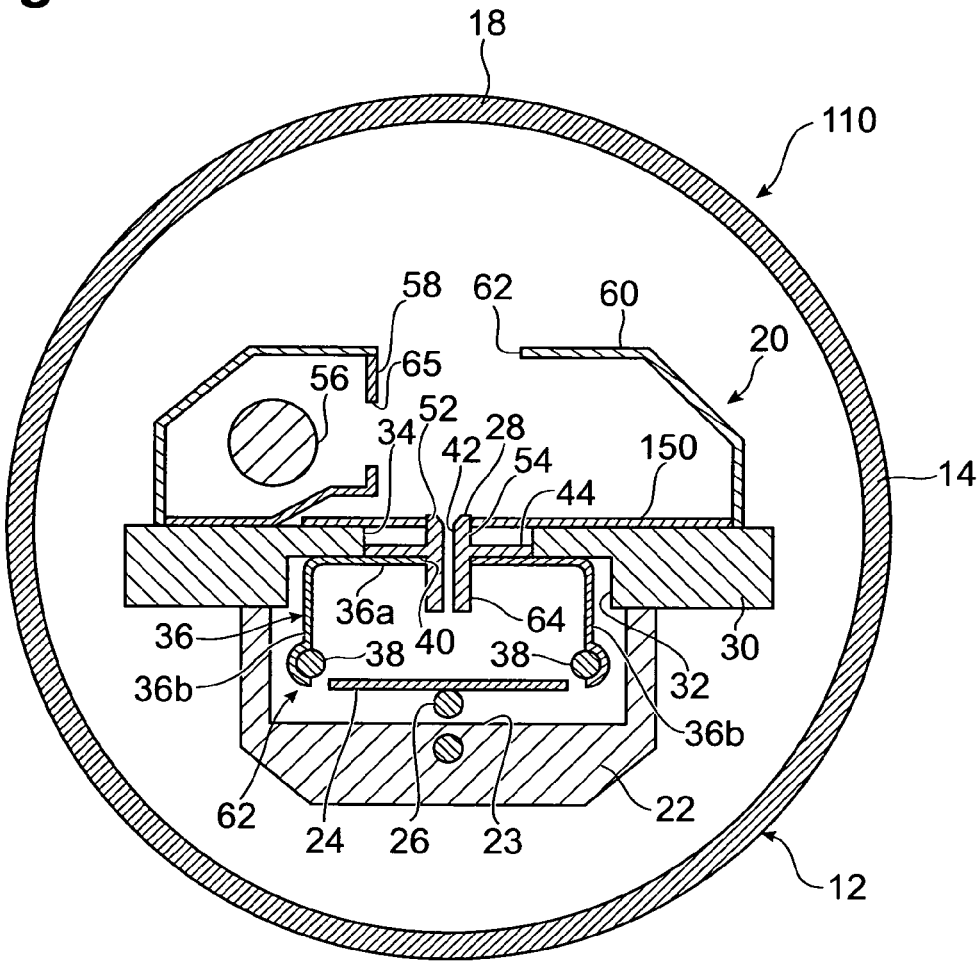
FIG. 6 is a sectional view showing a second embodiment of a gas discharge tube of the invention.
Figure 7:
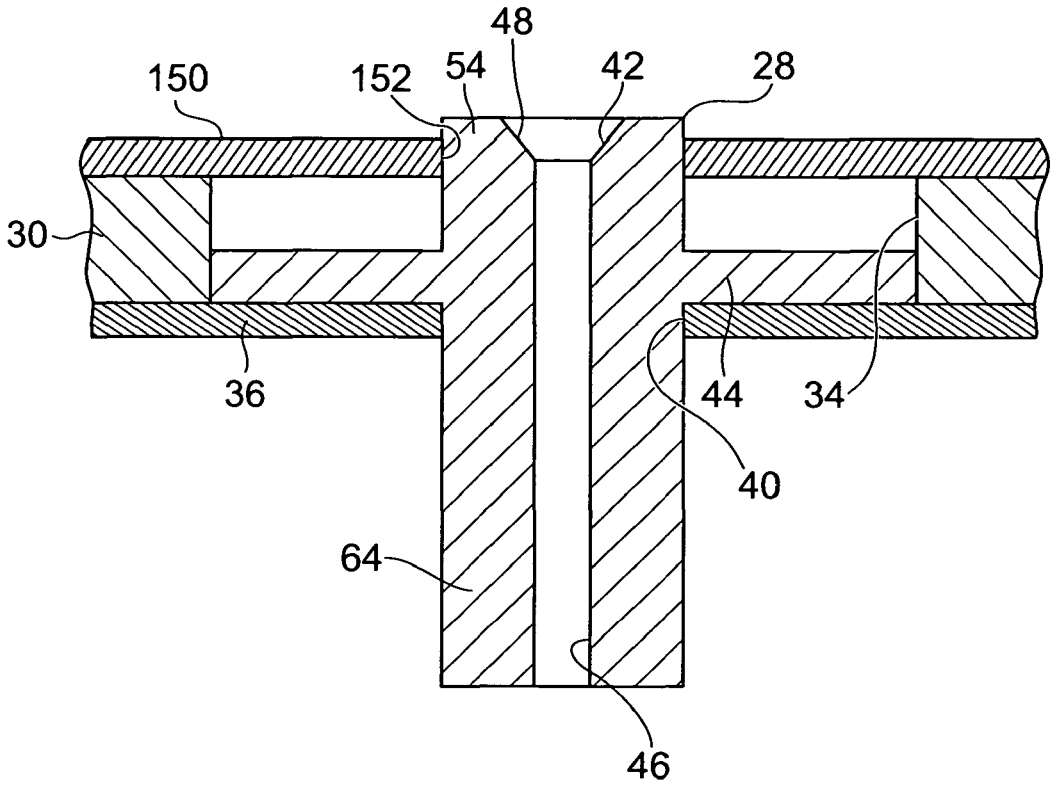
FIG. 7 is a sectional view of a part restricting the discharge path and a periphery thereof in the gas discharge tube of FIG. 6 in an enlarged manner.

FIG. 6 is a sectional view showing a second embodiment of a gas discharge tube of the invention, and FIG. 7 is a sectional view of a part restricting the discharge path and a periphery thereof in the gas discharge tube of FIG. 6. The gas discharge tube 110 shown in FIG. 6 is different from the gas discharge tube 10 of the first embodiment in that a discharge shielding part 150 is made of an electrical insulating material such as ceramics.

In this gas discharge tube 110, as described above, the discharge shielding part 150 is made of an electrical insulating material such as ceramics, and therefore, as shown in FIG. 7, even when it is in contact with the part 28 restricting the discharge path, the discharge shielding part can shield discharge. Therefore, even if the positioning accuracy between the part 28 restricting the discharge path and the discharge shielding part 15 is low, electrical insulation from the part 28 restricting the discharge path can be easily realized, and the manufacturing becomes easy. In this second embodiment, the inner diameter of the opening 152 of the discharge shielding part 150 is made substantially the same as the outer diameter of the first projecting portion 54 of the part 28 restricting the discharge path so as not to form a gap between the discharge shielding part 150 and the part 28 restricting the discharge path at all. Therefore, the shielding effect of the discharge path between the outer peripheral surface of the part 28 restricting the discharge path on the side lower than the discharge shielding part 150 and the cathode 56 becomes higher, and the density of electrons in the expanded diameter hole 48 of the part 28 restricting the discharge path is made higher, and main discharge is reliably generated from the starting discharge.

Figure 8:
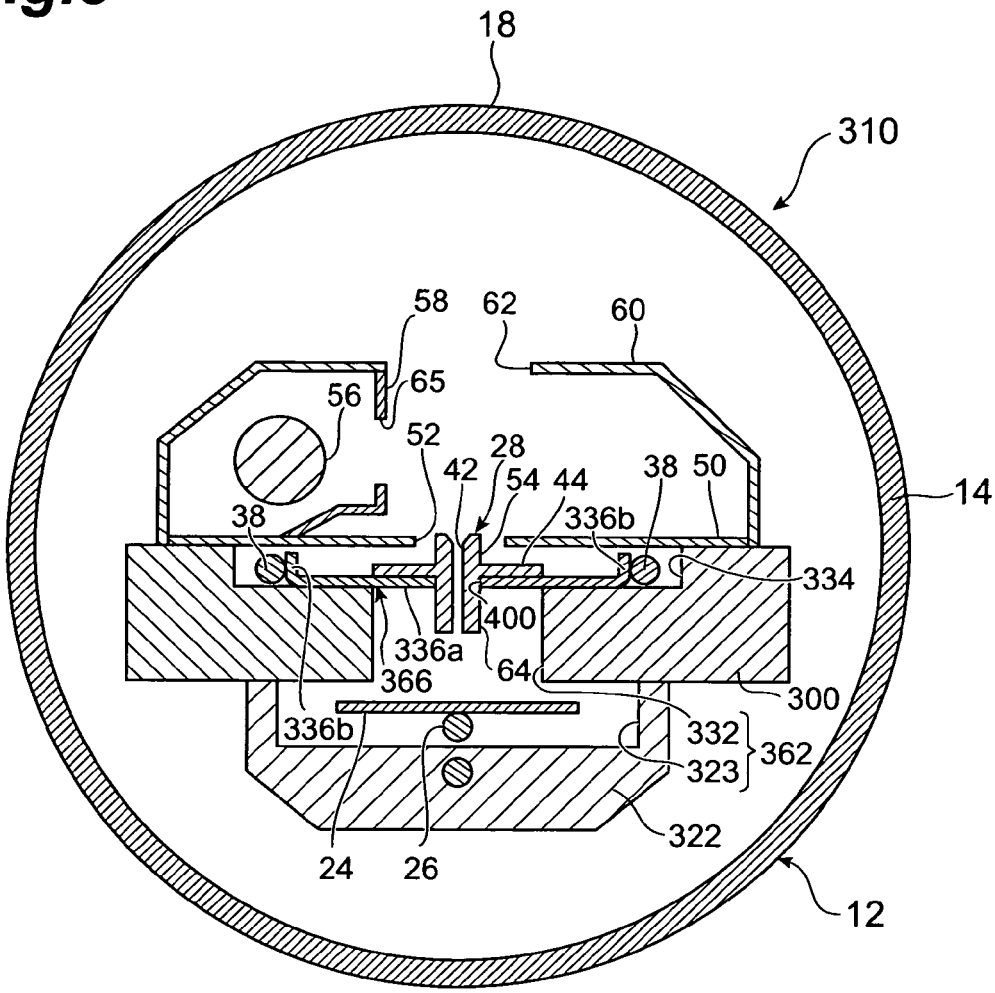
FIG. 8 is a sectional view showing a third embodiment of a gas discharge tube of the invention.

FIG. 8 is a sectional view showing a third embodiment of a gas discharge tube of the invention. The point of difference of the gas discharge tube 310 of this third embodiment from the gas discharge tube 10 of the first embodiment is described as follows. First, the support 300 to be used instead of the support 30 (support for the part restricting the discharge path) has a large-diameter concave portion 334 on the cathode 56 side, and at substantially the center of this concave portion 334, an opening 332 which has a diameter smaller than that of the concave portion 334 and perforates through to the anode 24 side is provided. Arms (peripheral portions) 336*b* of the conductive plate 336 to be used instead of the conductive plate 36 project to the cathode 56 side and are fixed to the tip ends of stem pins 38 disposed in the concave portion 334 of the support 300. In the conductive plate main body 336*a* to be supported by the support 300, an opening 400 in which the part 28 restricting the discharge path is inserted is formed, and by supporting the flange 44 of the part 28 restricting the discharge path by this conductive plate main body 336*a*, flange 44 of the part 28 restricting the discharge path is indirectly supported by the support 300. Furthermore, the base 322 to be used instead of the base 22 has a concave portion 323 which covers the opening 332 of the support 300 from the anode 24 side and in which the anode 24 is disposed, and a space (communicated space) formed by the concave portion 323 of the base 322 and the opening 332 of the support 300 is used as an anode housing space (space on the side where the anode is positioned) 362 for housing the anode 24.

Also in the gas discharge tube 310 of the third embodiment constructed as described above, most of the discharge path from the outer peripheral surface of the part 28 restricting the discharge path to the cathode 56 is shielded by the discharge shielding part 50, and only the end of the first projecting portion 54 of the part 28 restricting the discharge path forms a discharge path for starting discharge between the same and the cathode 56, so that the starting discharge is reliably generated, and the part 28 restricting the discharge path extends so as to project to the anode 24 side and the anode housing space 362 for housing this second projecting portion 64 and the anode 24 is formed, so that a temperature rise of the anode 24 is prevented and evaporated products from the anode 24 are reduced. Namely, the same effect as that of the gas discharge tube 10 of the first embodiment can be obtained. Additionally, it is possible to apply the construction of the second embodiment to the gas discharge tube 310 of the third embodiment.

Figure 9:
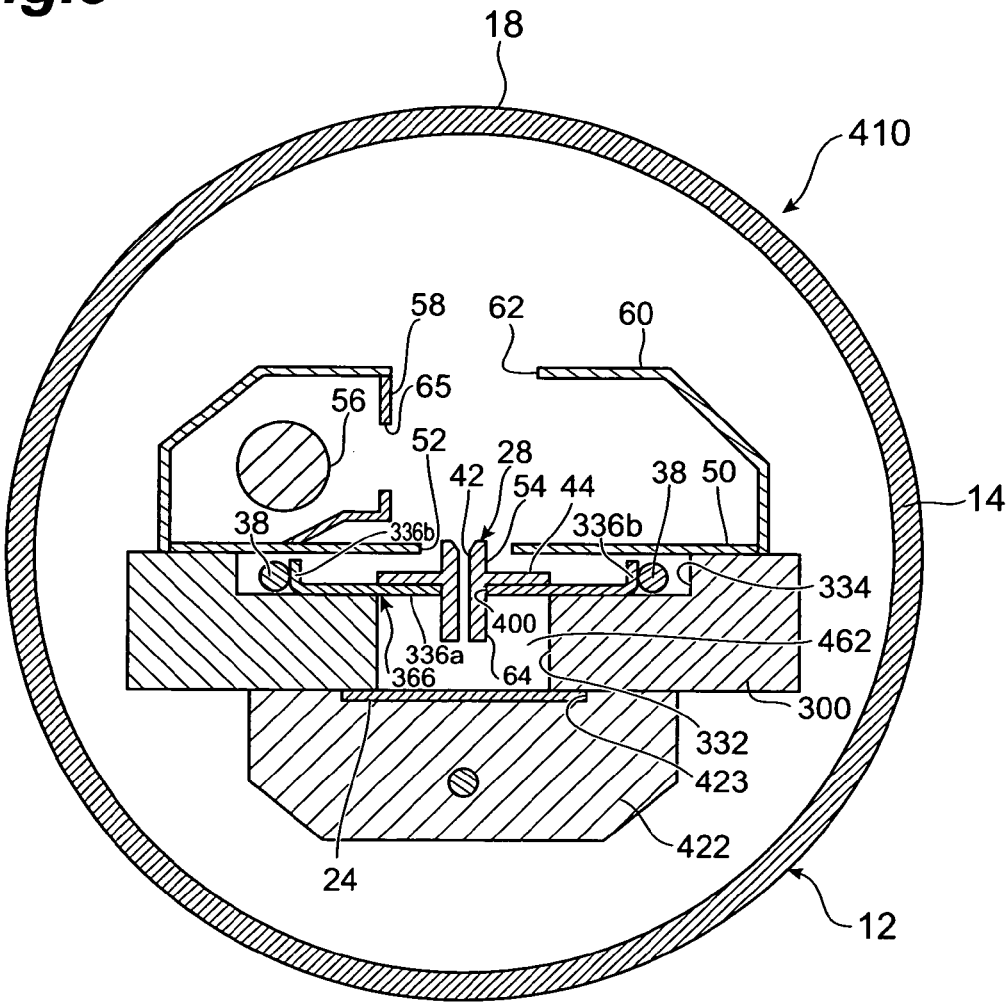
FIG. 9 is a sectional view showing a fourth embodiment of a gas discharge tube of the invention.

FIG. 9 is a sectional view showing a fourth embodiment of a gas discharge tube of the invention. The point of difference of the gas discharge tube 410 of the fourth embodiment from the gas discharge tube 310 of the third embodiment is that a base 422 having a concave portion 423 smaller than the concave portion 323 is used instead of the base 322, the anode 24 is housed in this concave portion 423 and a peripheral portion thereof is sandwiched between the base 422 and the support 300, and a space formed by closing the opening 332 of the support 300 by the exposed surface of the anode 24 is used as a space (anode housing space) 462 on the side where the anode 24 is positioned. The stem pin for the anode 24 is electrically connected to the back side in a direction perpendicular to the drawing sheet surface of the anode.

Also in the gas discharge tube 410 of the fourth embodiment thus constructed, as a matter of course, the same effect as that of the gas discharge tube 310 of the third embodiment is obtained. Additionally, it is possible to apply the construction of the second embodiment to the gas discharge tube 410 of the fourth embodiment.

Figure 10:
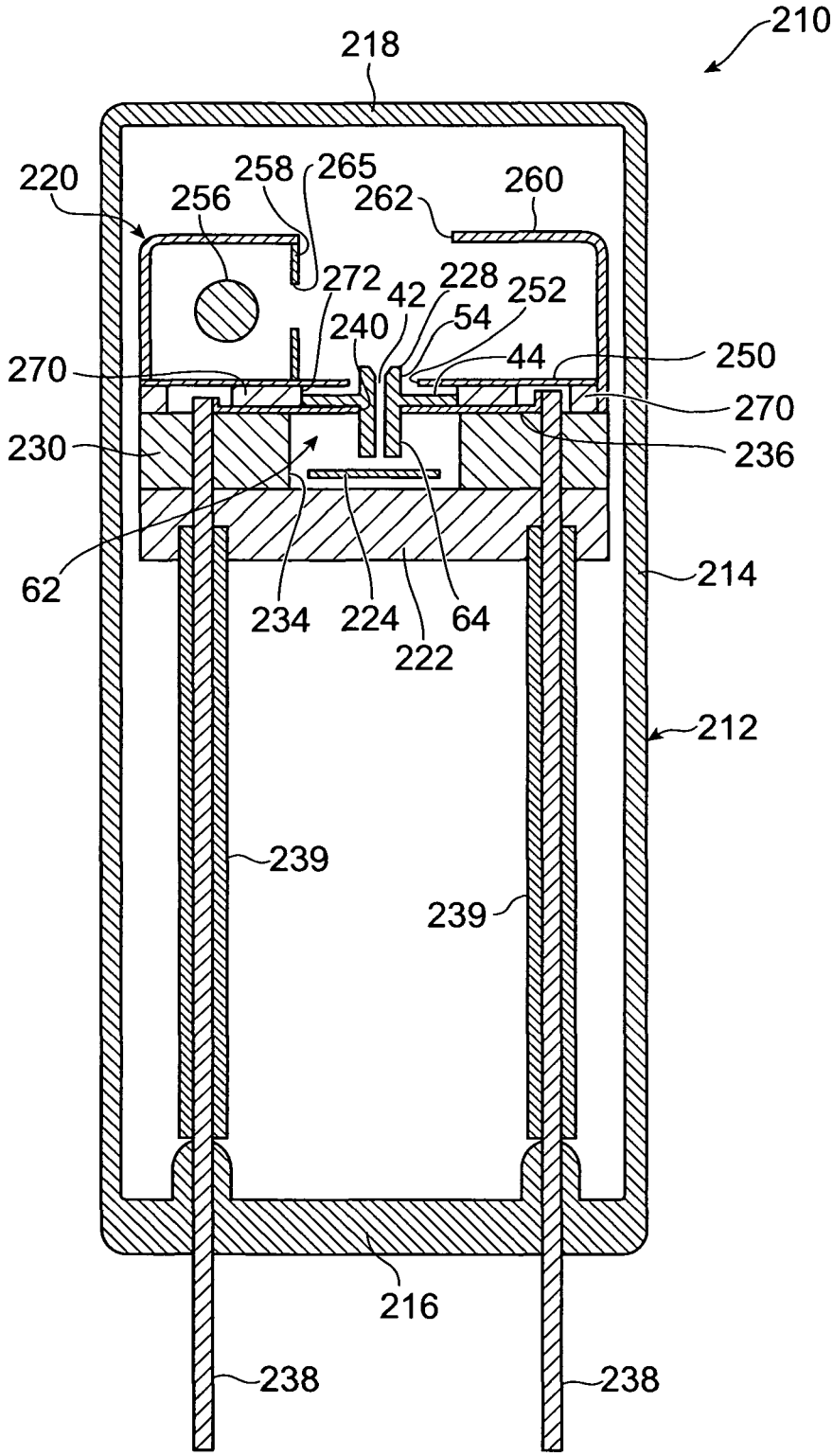
FIG. 10 is a sectional view showing a fifth embodiment of a gas discharge tube of the invention.

FIG. 10 is a sectional view of a fifth embodiment of a gas discharge tube of the invention, cut along an axial direction. This gas discharge tube 210 is a so-called head-on type deuterium lamp, and has a glass-made sealed container 212 in which a deuterium gas is sealed by a pressure of several hundreds Pa. This sealed container 212 includes a cylindrical side tube portion 214, a stem portion 216 which seals the lower end side of the side tube portion 214, and a light exit window 218 which seals the upper end side. In the sealed container 212, a light emitting part assembly 220 is housed.

The light emitting part assembly 220 has an electrical insulating disk-shaped base 222 made of ceramics or the like. The base 222 is disposed so as to face the light exit window 218. Above the base 222, an anode 224 is disposed, and to this anode 224, a tip end of a stem pin (not shown) which is stood on the stem portion 216 and extends in the tube axial (central axis of the side tube) direction is electrically connected.

The light emitting part assembly 220 has an electrical insulating support for the part restricting the discharge path (support) 230 made of ceramics or the like. This support 230 is disposed and fixed so as to overlap the upper surface of the base 222. At the center of the support 230, a circular opening 234 is formed, and this opening is used as an anode housing space 62 for housing the major portion (portion shown in FIG. 8) of the anode 224. In a state that the major portion of the anode 224 is disposed within the anode housing space 62 and the support 230 is overlapped and fixed onto the base 222, an unillustrated end of the anode 224 is sandwiched between the support 230 and the base 222.

Furthermore, on the upper surface of the support 230, a conductive plate 236 is disposed in contact with it. This conductive plate 236 is electrically connected to tip end portions of stem pins 238 stood on the stem portion 216. The stem pins 238 and the stem pin connected to the anode 224 are enveloped by electrical insulating tubes 239 made of ceramics so as not to be exposed between the stem portion 216 and the base 222.

In the conductive plate 236, a circular opening 240 smaller than the inner diameter of the opening 234 of the support 230 is formed, and in a state that the conductive plate 236 is fixed onto the support 230, this opening 240 is disposed coaxially with the opening 234 of the support 230.

To the center of the upper surface of the conductive plate 236, for narrowing or restricting the discharge path from the anode 224, a part 228 restricting the discharge path made of a metal is welded and fixed so as to be coaxial with the openings 234 and 240. Therefore, to this part 228 restricting the discharge path, power can be supplied from the outside via the conductive plate 236 and the stem pins 238.

This part 228 restricting the discharge path is substantially equivalent to the part 28 restricting the discharge path of the first embodiment, that is, the part restricting the discharge path clearly shown in FIG. 5. Therefore, briefly describing this by using the same reference numerals and referring to FIG. 5, this part 228 restricting the discharge path includes a first projecting portion 54, the flange 44, and the second projecting portion 64, and in this part, a through hole 42 including the small hole 46 and the expanded diameter hole 48 is formed, and while the part restricting the discharge path is inserted into the opening 240 of the conductive plate 236, the flange 44 is fixed to the conductive plate 236.

Furthermore, the light emitting part assembly 220 has a disk-shaped support 270 for a discharge shielding part for supporting a discharge shielding part 250 that will be described later. This support 270 for the discharge shielding part is made of an electrical insulating material such as ceramics, and is disposed in contact on the upper surface of the support 230. At the center of the support 270 for the discharge shielding, an opening 272 is formed, and the flange 44 of the part 228 restricting the discharge path enters and is disposed into and the first projecting portion 54 is inserted into the opening 272.

The discharge shielding part 250 is a conductive disk of a metal, and is disposed in contact on the upper surface of the support 270 for the discharge shielding part. At the center of the discharge shielding part 250, an opening 252 is formed, and in an assembled state, this opening 252 is made coaxial with the opening 272 of the support 270 for the discharge shielding part. A total H of the length of the first projecting portion 54 in the longitudinal direction of the part 228 restricting the discharge path and the thickness of the flange 44 is slightly longer than a total T of the thickness of the support 270 for the discharge shielding part and the thickness of the discharge shielding part 250, and in an assembled state, the upper end of the part 228 restricting the discharge path projects by a predetermined projecting amount P preferably not more than 0.5 mm, more preferably approximately 0.3 mm from the upper surface of the discharge shielding part 250 through the opening 252 of the discharge shielding part 250. The projecting amount P is smaller than the length h of the expanded diameter hole 48 of the part 228 restricting the discharge path, and the lower end of the expanded diameter hole 48 is positioned lower than the upper surface of the discharge shielding part 250. Furthermore, the inner diameter of the opening 252 is slightly larger than the outer diameter of the first projecting portion 54 of the part 228 restricting the discharge path, and between these, a small gap is formed. Thereby, the discharge shielding part is insulated from the part 228 restricting the discharge path and other portions to which potentials are applied. This gap enables substantial discharge shielding.

The light emitting part assembly 220 has a cathode 256 disposed at a position on the light exit window 218 side deviating from the optical path. This cathode 256 is for generating thermions, and in detail, it is formed by applying electron radiating matter on a tungsten-made coil extended in the tube axis direction. Such a cathode 256 is electrically connected to an external power source via a connecting pin on the tip end of a stem pin (not shown) stood on the stem portion 216, and can be supplied with power from the outside.

Furthermore, the light emitting part assembly 220 has a metal-made front cover 260 and a discharge rectifier plate 258 so as to prevent spatter or evaporated products from the cathode 256 from adhering to the light exit window 218. The front cover 260 is disposed so as to cover the surface on the light exit window 218 side of the discharge shielding part 250 and the cathode 256, and fixed to the discharge shielding part 250. In this front cover 260, at a position corresponding to the opening 252 of the discharge shielding part 250, a light pass-through opening 262 which an ultraviolet ray passes through is formed. The discharge rectifier plate 258 is disposed so as to surround the cathode 256 in conjunction with the cathode 256 side (left in FIG. 8) portion of the front cover 260, and is fixed to the discharge shielding part 250. At a portion facing the cathode 256 of the discharge rectifier plate 258, an opening 265 is formed, and thermions generated at the cathode 256 pass through this opening 265.

The gas discharge tube 210 according to the fifth embodiment constructed as described above is different between a head-on type and a side-on type, however, it has substantially the same part 228 restricting the discharge path and discharge shielding part 250 as those of the gas discharge tube 10 of the first embodiment, and has no difference in dimensions and positional relationship of these from the gas discharge tube 10, so that it brings about the same effect of reliably generating starting discharge and reliably generating main discharge. In addition, evaporated products from the anode 224 are reduced, so that stable discharge can be maintained over a long period of time. A formed arc ball is in a stable satisfactory shape, so that the radiation light becomes stable light with high luminance and a sufficient light amount. The operations of the gas discharge tube 110 are the same as those of the gas discharge tube 10 described above, so that description thereof is omitted.

Incidentally, the discharge shielding part 250 in the gas discharge tube 210 of the fifth embodiment is made of a conductive material such as a metal, however, those skilled in the art will easily understand that it may be made of an electrical insulating material such as ceramics, and in this case, the construction shown in FIG. 6 and FIG. 7 as the second embodiment is also applicable.

The invention is described in detail above based on the embodiments thereof, however, the invention is not limited to the above-described embodiments. For example, in the above-described embodiments, the part 28, 228 restricting the discharge path has a flange 44 for supporting this part 28, 228 restricting the discharge path, however, it is also possible that a step is formed on the outer peripheral surface of the part 28, 228 restricting the discharge path and the part restricting the discharge path is supported by using this step, or the part 28, 228 restricting the discharge path may be supported by other shapes and methods.

INDUSTRIAL APPLICABILITY

The structure of the gas discharge tube of the invention is preferably applicable to a deuterium lamp to be used as a light source of a spectroscope or chromatography, etc.

The invention claimed is:

1. A gas discharge tube which emits light to an outside from a light exit window of a sealed container in which a gas is sealed by generating discharge between an anode and a cathode which are disposed in the sealed container, comprising:

a cylindrical part restricting a discharge path, the cylindrical part being disposed between the anode and the cathode and having a through hole for narrowing the discharge path between the anode and the cathode, the cylindrical part being conductive and being electrically connected to an external power source; and a planar discharge shielding part which is disposed so as to cover a surrounding of the part restricting the discharge path and is electrically insulated from the part restricting the discharge path;

wherein the part restricting the discharge path has an end on the cathode side projecting by a predetermined projecting amount more than a surface on the cathode side of the discharge shielding part and an end on the anode side projecting below the entire discharge shielding part into a space where the anode is positioned, and the projecting amount of the part restricting the discharge path to the cathode side is not more than 0.5 mm.

2. The gas discharge tube according to claim 1, wherein the through hole of the part restricting the discharge path comprises a small hole with a constant inner diameter provided on the anode side and an expanded diameter hole in a funnel shape which extends continuously from the small hole to the cathode side and has an inner diameter expanded toward the cathode side.

3. The gas discharge tube according to claim 2, wherein a boundary between the small hole and the expanded diameter hole is disposed closer to the anode side than the cathode side surface of the discharge shielding part.

4. A gas discharge tube which emits light to an outside from a light exit window of a sealed container in which a gas is sealed by generating discharge between an anode and a cathode which are disposed in the sealed container, comprising:

a cylindrical part restricting a discharge path, the cylindrical part being disposed between the anode and the cathode and having a through hole for narrowing the discharge path between the anode and the cathode, the cylindrical part being conductive and being electrically connected to an external power source; and a planar discharge shielding part which is disposed so as to cover a surrounding of the part restricting the discharge path and is electrically insulated from the part restricting the discharge path;

wherein the part restricting the discharge path has an end on the cathode side projecting by a predetermined projecting amount more than a surface on the cathode side of the discharge shielding part and an end on the anode side projecting below the entire discharge shielding part into a space where the anode is positioned, and the through hole of the part restricting the discharge path comprises a small hole with a constant inner diameter provided on the anode side and an expanded diameter hole in a funnel shape which extends continuously from the small hole to the cathode side and has an inner diameter expanded toward the cathode side, and wherein when an inner diameter of the small hole is defined as D1 and a maximum inner diameter of the expanded diameter hole is defined as D2, D2 is not less than 1 mm and not more than 3 mm, and a ratio D2/D1 is not less than 4 and not more than 10.

5. The gas discharge tube according to claim 1, wherein the discharge shielding part is made of an electrical insulating material.

6. The gas discharge tube according to claim 1, wherein the part restricting the discharge path has, on its outer peripheral surface, a flange portion that is configured so that end faces on the cathode side and the anode side of the part restricting the discharge path project via first and second projection portions to the cathode side and the anode side, respectively, from the flange portion.

7. A gas discharge tube which emits light to an outside from a light exit window of a sealed container in which a gas is sealed by generating discharge between an anode and a cathode which are disposed in the sealed container, comprising:

a part restricting a discharge path, the part being disposed between the anode and the cathode and having a through hole for narrowing the discharge path between the anode and the cathode, the part being conductive and being electrically connected to an external power source; and a support for the part restricting the discharge path, the support supporting the part restricting the discharge path and having a first surface provided on the cathode side and a second surface provided on the anode side, the first and second surfaces being opposite to each other;

a discharge shielding part which is disposed on the first surface of the support so as to cover a surrounding of the part restricting the discharge path and is electrically insulated from the part restricting the discharge path, the discharge shielding part having an opening;

wherein the part restricting the discharge path has, on its outer peripheral surface, a flange portion that is configured so that end faces on the cathode side and the anode side of the part restricting the discharge path project via first and second projection portions to the cathode side and the anode side, respectively, from the flange portion, and wherein the first projection portion of the part restricting the discharge path projects through the opening of the discharge shielding part, the end face on the cathode side of the part restricting the discharge path projects by a predetermined projecting amount more than a surface on the cathode side of the discharge shielding part and the end face on the anode side of the part restricting the discharge path projects into a space where the anode is positioned.

8. The gas discharge tube according to claim 1, comprising:

a support for the part restricting the discharge path, the support supporting the part restricting the discharge path;

wherein the part restricting the discharge path has, on its outer peripheral surface, a flange portion to be supported by the support for the part restricting the discharge path, and end faces on the cathode side and the anode side of the part restricting the discharge path project to the cathode side and the anode side, respectively, from the flange portion.

9. The gas discharge tube according to claim 4, comprising:

a support for the part restricting the discharge path, the support supporting the part restricting the discharge path;

wherein the part restricting the discharge path has, on its outer peripheral surface, a flange portion to be supported by the support for the part restricting the discharge path, and end faces on the cathode side and the anode side of the part restricting the discharge path project to the cathode side and the anode side, respectively, from the flange portion.

10. The gas discharge tube according to claim 4, wherein the discharge shielding part is made of an electrical insulating material.

11. The gas discharge tube according to claim 7, wherein the discharge shielding part is made of an electrical insulating material.

12. The gas discharge tube according to claim 4, wherein the part restricting the discharge path has, on its outer peripheral surface, a flange portion that is configured so that end faces on the cathode side and the anode side of the part restricting the discharge path project via first and second projection portions to the cathode side and the anode side, respectively, from the flange portion.

13. The gas discharge tube according to claim 7, wherein the through hole of the part restricting the discharge path comprises a small hole with a constant inner diameter provided on the anode side and an expanded diameter hole in a funnel shape which extends continuously from the small hole to the cathode side and has an inner diameter expanded toward the cathode side.

14. The gas discharge tube according to claim 13, wherein a boundary between the small hole and the expanded diameter hole is disposed closer to the anode side than the cathode side surface of the discharge shielding part.

* * * * *